US008657709B2

(12) United States Patent
Bay

(10) Patent No.: US 8,657,709 B2
(45) Date of Patent: Feb. 25, 2014

(54) ARROWHEAD WITH LASER

(75) Inventor: Larry R. Bay, Renton, WA (US)

(73) Assignee: Clean-Shot Archery, Inc., Kent, WA (US)

( * ) Notice: Subject to any disclaimer, the term of this patent is extended or adjusted under 35 U.S.C. 154(b) by 0 days.

(21) Appl. No.: 13/273,932

(22) Filed: Oct. 14, 2011

(65) Prior Publication Data

US 2012/0035006 A1 Feb. 9, 2012

Related U.S. Application Data

(63) Continuation-in-part of application No. 12/757,401, filed on Apr. 9, 2010, now Pat. No. 8,251,845.

(60) Provisional application No. 61/168,105, filed on Apr. 9, 2009.

(51) Int. Cl.
*F42B 6/08* (2006.01)

(52) U.S. Cl.
USPC ..... 473/583; 473/570

(58) Field of Classification Search
USPC ..... 473/570, 578, 582, 583, 585, 586
See application file for complete search history.

(56) References Cited

U.S. PATENT DOCUMENTS

| | | | | |
|---|---|---|---|---|
| 3,641,675 | A | 2/1972 | Funk, Jr. | |
| 4,340,930 | A | 7/1982 | Carissimi | |
| 4,547,837 | A | 10/1985 | Bennett | |
| RE32,123 | E | 4/1986 | Knight | |
| 4,621,817 | A * | 11/1986 | Musacchia | 473/583 |
| 5,134,552 | A | 7/1992 | Call et al. | |
| 5,141,229 | A | 8/1992 | Roundy | |
| 5,175,651 | A | 12/1992 | Marron et al. | |
| 5,419,050 | A | 5/1995 | Moore | |
| 5,634,278 | A | 6/1997 | London | |
| 5,871,410 | A | 2/1999 | Simo et al. | |
| 6,005,719 | A | 12/1999 | Rando | |
| 6,027,421 | A * | 2/2000 | Adams, Jr. | 473/578 |
| 6,040,566 | A | 3/2000 | Rioland et al. | |
| 6,077,179 | A | 6/2000 | Liechty, II | |
| 6,123,631 | A | 9/2000 | Ginder | |
| 6,134,793 | A | 10/2000 | Sauers | |
| 6,165,086 | A | 12/2000 | Liechty, II | |
| 6,171,206 | B1 | 1/2001 | Liechty, II | |
| 6,258,000 | B1 | 7/2001 | Liechty, II | |
| 6,287,223 | B1 | 9/2001 | Liechty, II | |
| 6,287,224 | B1 | 9/2001 | Liechty, II | |
| 6,306,053 | B1 | 10/2001 | Liechty, II | |

(Continued)

OTHER PUBLICATIONS

U.S. Appl. No. 61/293,504, filed Jan. 8, 2010; 56 pages.

(Continued)

*Primary Examiner* — John Ricci
(74) *Attorney, Agent, or Firm* — Skaar Ulbrich Macari, P.A.

(57) ABSTRACT

An arrow, arrowhead and method of shooting an arrowhead are disclosed. In one example embodiment, a plurality of blades extend outwardly from the body of an arrowhead and a sharpened tip extends forwardly. A front laser diode is disposed in the arrowhead and is arranged so that a laser beam emitted by the diode projects forward from the arrowhead through an aperture in the tip and is coaxial with the tip's center axis. In another example embodiment, the housing includes a rear facing light source to selectively light the nock. The method includes indexing the arrowhead to the vanes by tightening a set screw disposed in a portion of the arrowhead disposed in the arrow shaft.

22 Claims, 19 Drawing Sheets

(56) References Cited

U.S. PATENT DOCUMENTS

| | | | | |
|---|---|---|---|---|
| 6,366,344 | B1 | 4/2002 | Lach | |
| 6,390,642 | B1 | 5/2002 | Simonton | |
| 6,409,617 | B1 | 6/2002 | Armold | |
| 6,428,433 | B1 | 8/2002 | Liechty, II | |
| 6,428,434 | B1 | 8/2002 | Liechty, II | |
| 6,490,060 | B1 | 12/2002 | Tai et al. | |
| 6,526,666 | B1 | 3/2003 | Lastinger, Jr. | |
| 6,622,392 | B1 | 9/2003 | Bourget | |
| 6,743,128 | B2 | 6/2004 | Liechty, II | |
| 6,755,758 | B2 | 6/2004 | Liechty, II | |
| 6,758,774 | B2 | 7/2004 | Liechty, II | |
| 6,851,197 | B2 | 2/2005 | Terry et al. | |
| 6,997,716 | B2 | 2/2006 | Skala et al. | |
| 7,216,643 | B2 | 5/2007 | Pellerite | |
| 7,231,721 | B2 | 6/2007 | Minica et al. | |
| 7,241,236 | B1 * | 7/2007 | Chen | 473/578 |
| 7,313,871 | B2 | 1/2008 | Lines et al. | |
| 7,314,419 | B2 * | 1/2008 | Grace et al. | 473/583 |
| 7,316,625 | B2 | 1/2008 | Takahashi | |
| 7,409,770 | B2 | 8/2008 | Jones | |
| 7,837,580 | B2 | 11/2010 | Huang et al. | |
| 7,927,240 | B2 | 4/2011 | Lynch | |
| 7,931,550 | B2 | 4/2011 | Lynch | |
| 7,972,230 | B2 | 7/2011 | Donahoe | |
| 7,993,224 | B2 | 8/2011 | Brywig | |
| 8,221,273 | B2 * | 7/2012 | Donahoe | 473/578 |
| 2002/0197584 | A1 | 12/2002 | Kendir et al. | |
| 2003/0063959 | A1 * | 4/2003 | Kao | 411/60.2 |
| 2004/0014010 | A1 | 1/2004 | Swensen et al. | |
| 2005/0278964 | A1 | 12/2005 | Minica et al. | |
| 2011/0172039 | A1 | 7/2011 | Donahoe et al. | |

OTHER PUBLICATIONS

U.S. Appl. No. 61/293,757, filed Jan. 11, 2010; 104 pages.

* cited by examiner

ARROWHEAD WITH LASER

PRIORITY

This application is a continuation-in-part of U.S. patent application Ser. No. 12/757,401, filed on Apr. 9, 2010, which claims priority benefit of U.S. Provisional Patent Application No. 61/168,105, filed on Apr. 9, 2009, the disclosure of each of the foregoing are hereby incorporated by reference herein in their entirety.

FIELD

The present invention relates to an arrowhead configured to project a laser beam, and more particularly, an arrowhead having a penetrating tip with a centrally located aperture that permits an axially aligned laser to project therefrom.

BACKGROUND

Accurate aiming in archery/cross bow and bow hunting of game is highly desired. Efforts have been made to utilize lasers to assist the user in improving aiming accuracy. One such attempt is disclosed in U.S. Pat. No. 6,134,793 to Sauers. The '793 patent discloses a laser aided alignment system wherein a laser tip is placed on an arrow shaft and the user can adjust the bow's sights to correspond to the projection of the laser on a given target. However, the laser tip disclosed in the '793 patent is only for alignment of the bow sight. It is not for aiming a shot and is not for being shot from the bow as a projectile.

U.S. Pat. No. 7,231,721 to Minica et al. discloses a laser projecting arrowhead that can be shot as a projectile. However, the aperture through which the laser projects is offset from the center axis of the arrow. Thus, the laser beam projected on the target will not correspond to the exact spot that the tip of the arrow will first contact. The '721 patent also does not disclose any method or means for turning the laser beam on or off. Thus, the battery may be more quickly drained and the beam could be unintentionally aimed in potentially dangerous directions, such as at aircraft or other persons, while the user is on the move.

Therefore, there remains a need to provide an improved arrowhead that facilitates aiming and addresses certain disadvantages of the prior art.

SUMMARY

The present disclosure teaches various example embodiments that address certain disadvantages in the prior art. An arrow, arrowhead and method of shooting an arrowhead are disclosed. In one example embodiment, an arrowhead includes a body. The body includes an internal cavity. A plurality of blades extend outwardly from the body. A sharpened tip extends forwardly from the body, with the tip having a center axis, and an aperture formed in the tip that extends outward along the center axis of the tip. A battery housing extends rearwardly from the body and includes a rearwardly extending threaded portion. The threaded portion includes a hole defined longitudinally therethrough. The threaded portion is sectioned longitudinally into first and second halves with a slot defined between the first and second halves. A battery is disposed in the battery housing. A front laser diode is disposed in the internal cavity of the body. The front laser diode is arranged so that the laser beam emitted by the diode projects forward from the arrowhead through the aperture in the tip. The laser beam is coaxial with the center axis of the tip.

In another example embodiment, an arrow is provided. The arrow includes a hollow shaft having a front end and a rear end. A nock is disposed on the rear end of the shaft. An arrowhead is disposed at the front end of the shaft. The arrowhead includes a body having a forward end and a rearward end. It also includes a tip disposed on the forward end of the body. The tip includes a plurality of sharpened points and cutting edges. The arrowhead further includes a housing disposed on the rearward end of the body. The housing including a rearwardly extending threaded portion. The threaded portion is sectioned longitudinally into first and second halves with a slot defined between the first and second halves.

In a further example embodiment, a method of shooting an arrow is provided. The method includes indexing the arrowhead to the plurality of vanes by tightening a set screw disposed in a portion of the arrowhead. A magnet is disposed on the bow. The arrow is engaged with the bow and drawn back until a forward facing laser beam in the arrowhead turns on in response to a hall effect sensor sensing the presence of the magnet. The forward facing laser beam is turned off when the hall effect sensor does not sense the presence of the magnet.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
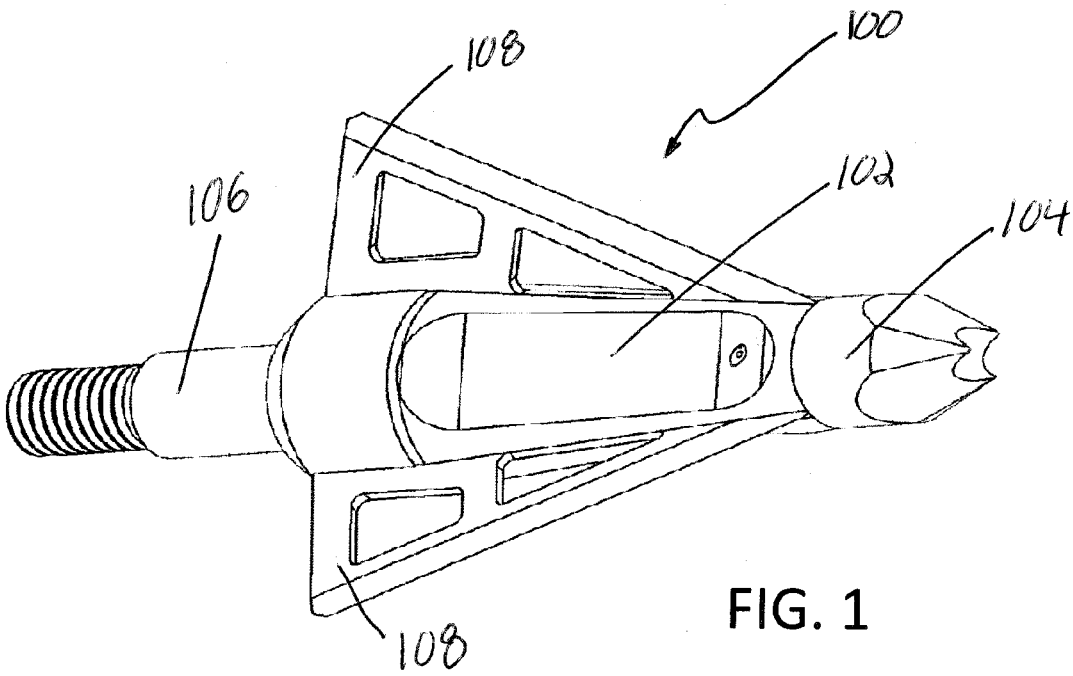
FIG. 1 is a perspective view of an arrowhead according to an example embodiment of the present invention.
Figure 2:
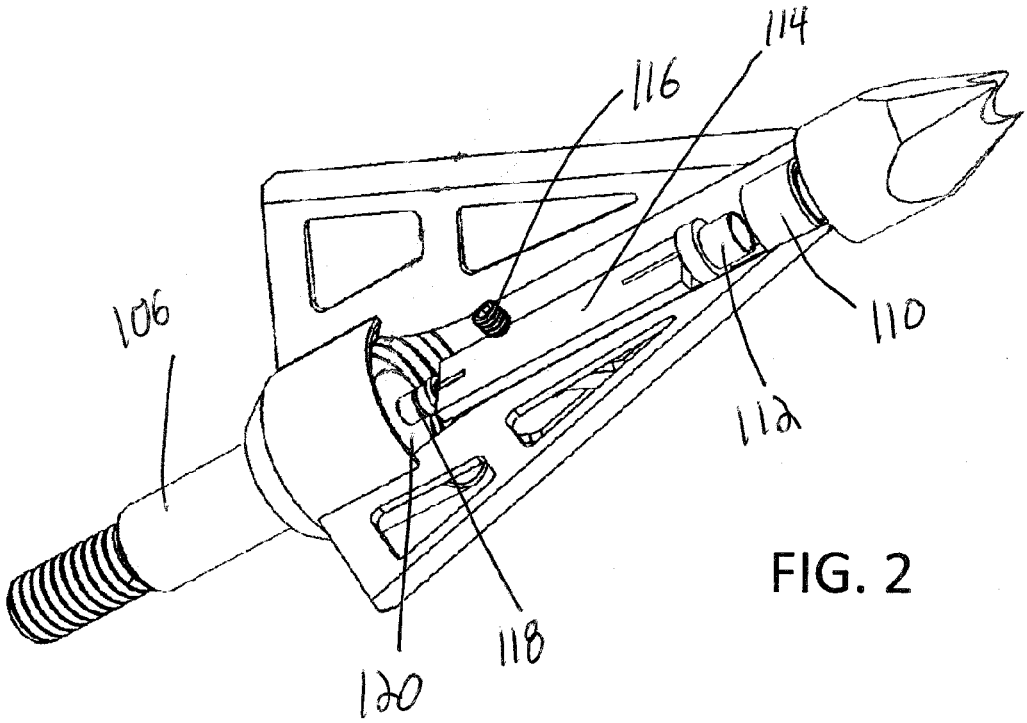
FIG. 2 is a cutaway perspective view of an arrowhead according to an example embodiment of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION

In the following description, the present invention will be explained with reference to example embodiments thereof. However, these example embodiments are not intended to limit the present invention to any specific environment, applications or particular implementations described in these example embodiments. Therefore, description of these example embodiments is only for purpose of illustration rather than limitation. It should be appreciated that, in the following example embodiments and the attached drawings, elements unrelated to the present invention are omitted from depiction; and dimensional relationships among individual elements in the attached drawings are illustrated only for ease of understanding, but not to limit the actual scale.

Referring to FIG. 1, the arrowhead 100 includes a body 102, a tip 104, battery housing 106 and blades 108. The tip 104 is disposed on a first end of the body 102 and the battery housing 106 is disposed on a second end of the body 102 opposite the first end. The blades 108 extend radially outwards form the body 102 and extend between the first and second ends. The radial height of the blades is greater at the second end of the body than at the first end of the body.

Referring to FIGS. 2-5, the arrowhead of FIG. 1 is shown without the body so that internal structures may be seen. Disposed within a hollow portion of the body 102, starting adjacent the first end and going rearwards, are a collimating lens 110, a front laser diode 112, a circuit board 114, a retention screw 116, a spring contact 118, and a battery 120.

The collimating lens 110 focuses and concentrates the light beam provided by laser diode 112 so that it projects from the center axis of the arrowhead. The lens 110 also seals out water and debris from entering the body of the arrowhead. The lens 110 is disposed adjacent the first end of the body 102 and adjacent to, or partially within, the tip 104.

Figure 3:
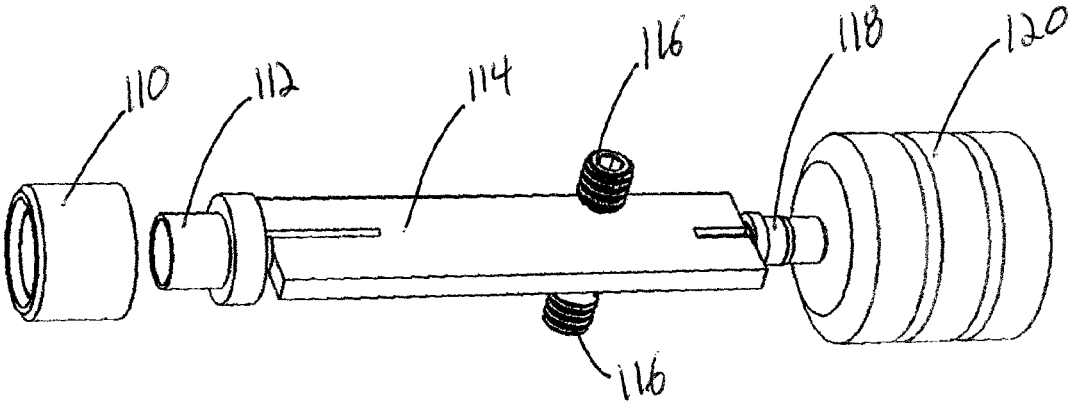
FIG. 3 is a perspective view of certain components of an arrowhead according to an example embodiment of the present invention.
Figure 4:
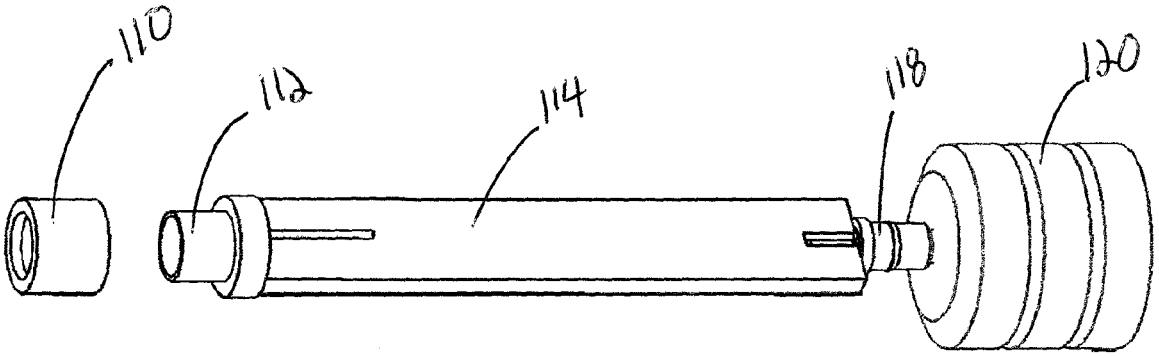
FIG. 4 is a perspective view of certain components of an arrowhead according to an example embodiment of the present invention.
Figure 5:
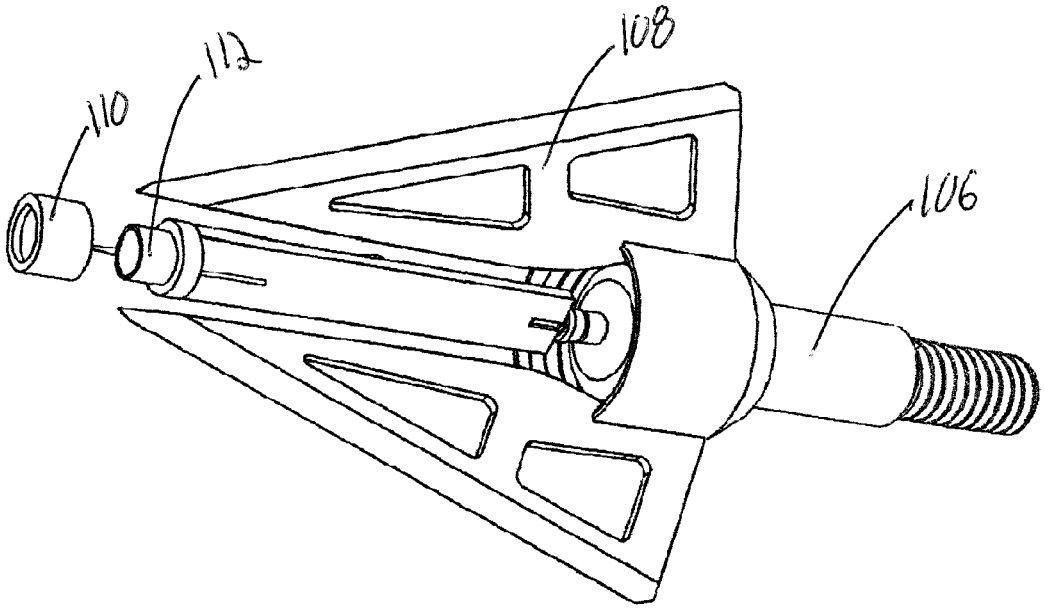
FIG. 5 is a cutaway perspective view of an arrowhead according to an example embodiment of the present invention.
Figure 6:
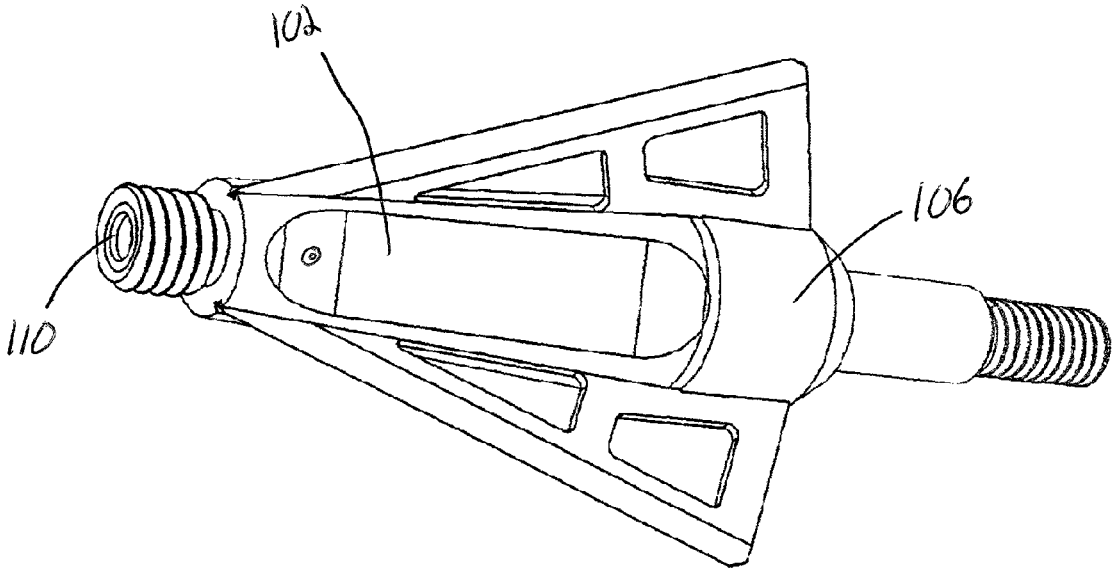
FIG. 6 is a perspective view of a portion of an arrowhead according to an example embodiment of the present invention.

The lens 110 in FIGS. 4-6 has a smaller diameter than the lens 110 of FIG. 3. By making the lens smaller, the lens can be fitted generally flush with the outer most or forward most surface of the body 102 as shown in FIG. 6. This arrangement minimizes the amount of debris that can accumulate inside the opening of the tip 104 and allows for an easy way to clean out the debris from the tip 104 and potentially polish the collimating lens 110 if it becomes scratched with repeated use.

The front laser diode 112 provides a laser beam that projects through the lens 110 and creates a single spot on the selected target. Persons skilled in the art will recognize that a variety of suitable laser diodes may be used, including, for example a 532 nm (green laser diode) 635 nm or 650 nm (red laser diode) or other visible light wavelengths. The front laser diode 112 is disposed adjacent to the lens 110 and faces the first end of the body 102 so that the laser beam projects forward from the tip 104.

The circuit board 114 is disposed between the front laser diode 112 and the spring contact 118. The circuit board 114 includes a hall effect sensor, an accelerometer and a microprocessor. The hall effect sensor responds to a change in magnetic field, so that it can function as an on/off switch when a magnet is placed on the user's bow. For example, the magnet can be placed on the shelf of the bow near the arrow rest. Then the hall effect sensor will cause the forward laser to turn on when the archer is at full draw. The hall effect sensor will also act as a draw length check because the laser will only activate when the bow is pulled back to a specific spot. The use of a hall effect sensor in this application will eliminate the need for a kisser button to verify that the arrow has been pulled back to the proper location prior to the shot. Once the arrow is released, the hall effect sensor will sense that the magnet is no longer present, and will then turn off the front laser diode 112, thereby saving battery power.

The accelerometer included in the circuit board 114 is responsive to acceleration forces. One suitable accelerometer is a 3-axis accelerometer, model CMA 3000 from VTI Technologies or the model ADXL-345 from Analog Devices. However, other types of accelerometers may be used without departing from the scope of the invention. Using information from the accelerometer, a rear laser or light emitting diode ("led") 122 (indicated in FIG. 9) can be turned on when a certain preset value is reached, for example the arrow reaching a speed of 150 feet per second. The laser or led output can be pulsed as well, for example, every 2 seconds. The rear laser or led 122 faces the rear of the arrow and illuminates a transparent nock as will be explained later in this specification. The lit or flashing nock enables a user to more easily find the arrow, including wounded game shot with the arrow. The rear facing laser or led 122 can also be controllably pulsed by the microprocessor such as model CY8C21123 from Cypress Semiconductor to transmit data to a receiver device, such as a laptop computer, IPHONE application, customized receiver unit or portable reception and processing device. The accelerometer further includes a tap sensing feature. Such feature allows the user to tap the arrow to turn the rear led or laser on/off or to transmit data, depending on the set number of taps corresponding to the desired function.

The microprocessor on the circuit board includes memory and programming to carry out the various functions described in this specification. Various flight data can be recorded in the memory, including flight time, acceleration, velocity and flight distance. This data can be useful to assist a user in fine-tuning or aligning a sighting/aiming system.

The alignment screws 116 are used to secure the circuit board. The positive terminal of the batteries contacts the battery housing 106 and then the arrowhead body 102. This configuration permits the screws 116 to transfer battery power from the arrowhead body 102 to the circuit board 114. The screws 116 will also ensure that the Hall Effect sensor on the circuit board 114 will remain in a given position to the outer body of the arrowhead to allow the hall effect sensor to properly detect the small magnetic field created by the magnet that is placed on the shelf of the bow on or near the arrow rest. The screws 116 further permit the user to align the arrow head 100 with the magnet on the bow.

A spring contact 118 is disposed between the circuit board 114 and the battery 120. The spring contact 118 makes contact with the negative side of the battery 120 and completes the circuit between the battery 120 and the circuit board 114. The compression resistance of the spring 118 also aids in keeping the battery 120 and circuit board 114 restrained.

The battery 120 is disposed within the battery cavity 122 portion of the battery housing 106. One suitable battery is an encasement of three 1.2V rechargeable Ni—MH button-cell batteries, totaling 3.6V, available from VARTA. However other suitable battery configurations may be selected by one of skill in the art without departing from the scope of the invention. The battery may comprise either a single battery unit, or a multi-unit configuration.

Figure 9:
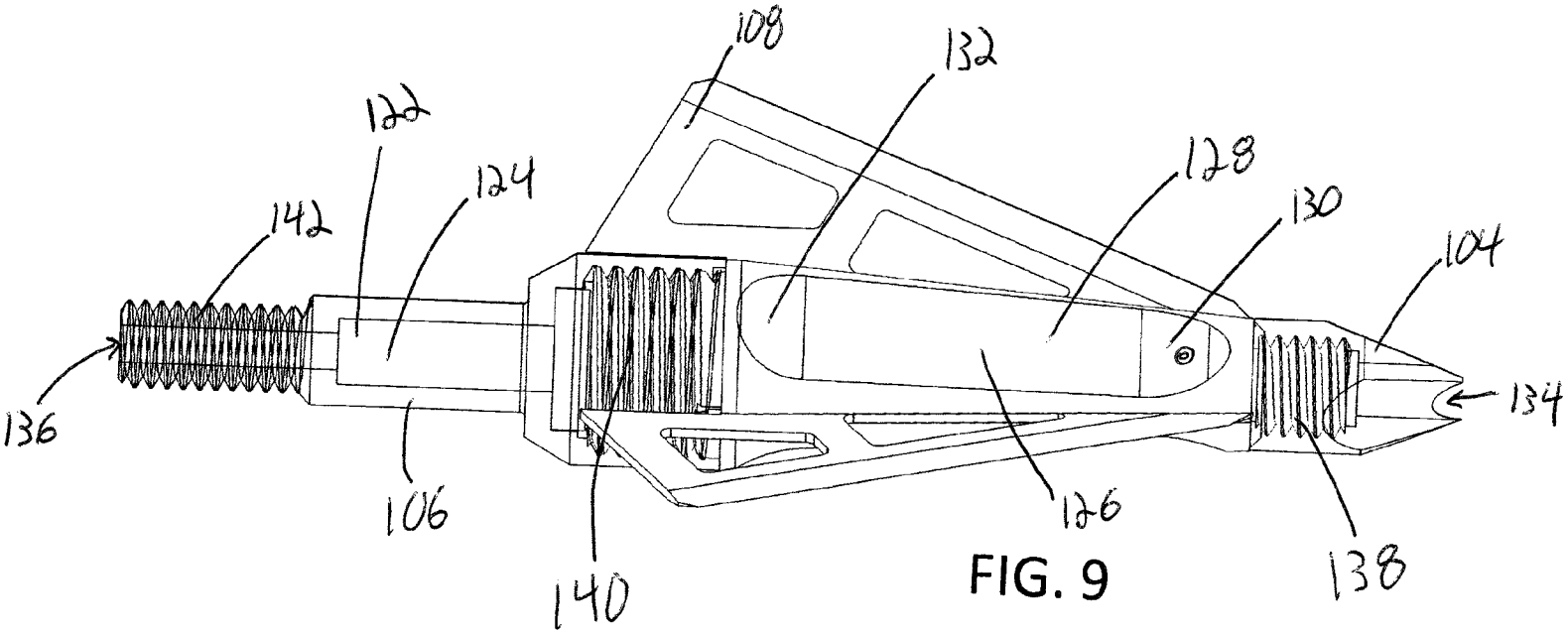
FIG. 9 is a side view of an arrowhead showing hidden detail according to an example embodiment of the present invention.
Figure 14:
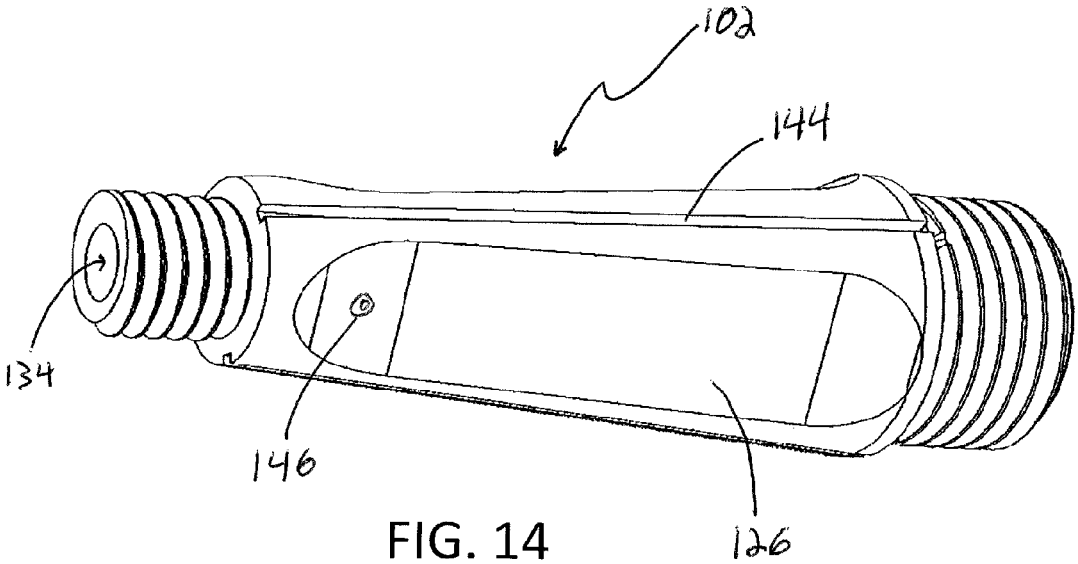
FIG. 14 is a perspective view of an arrowhead body according to an example embodiment of the present invention.
Figure 10:
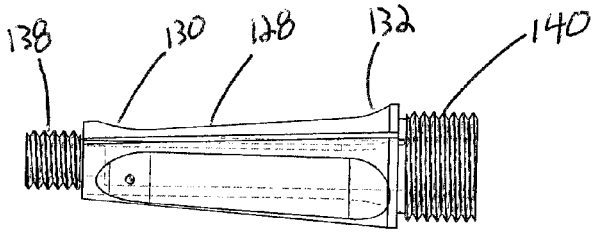
FIG. 10 is a side view of an arrowhead body according to an example embodiment of the present invention.
Figure 12:
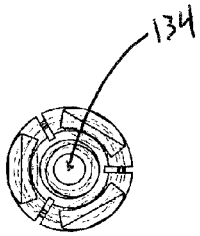
FIG. 12 is a front view of an arrowhead body according to an example embodiment of the present invention.
Figure 11:
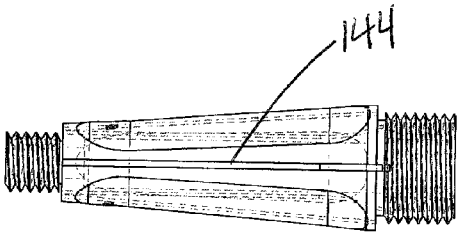
FIG. 11 is another side view of an arrowhead body according to an example embodiment of the present invention.
Figure 13:
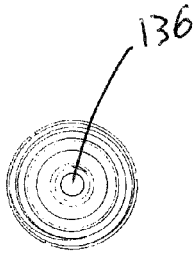
FIG. 13 is a rear view of an arrowhead body according to an example embodiment of the present invention.
Figure 16:
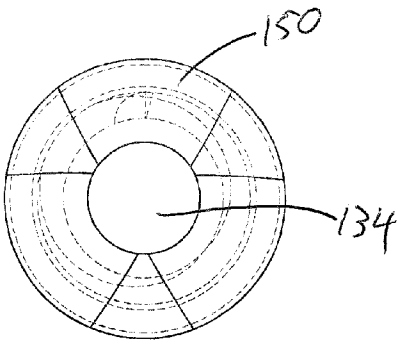
FIG. 16 is a front view of an arrowhead tip according to an example embodiment of the present invention.
Figure 18:
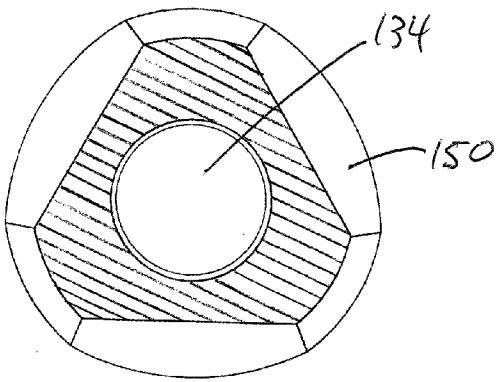
FIG. 18 is a front cross-sectional view of an arrowhead tip according to an example embodiment of the present invention.
Figure 15:
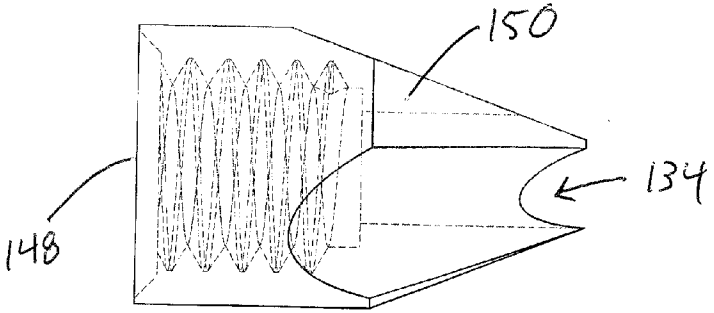
FIG. 15 is a side view of an arrowhead tip according to an example embodiment of the present invention.
Figure 17:
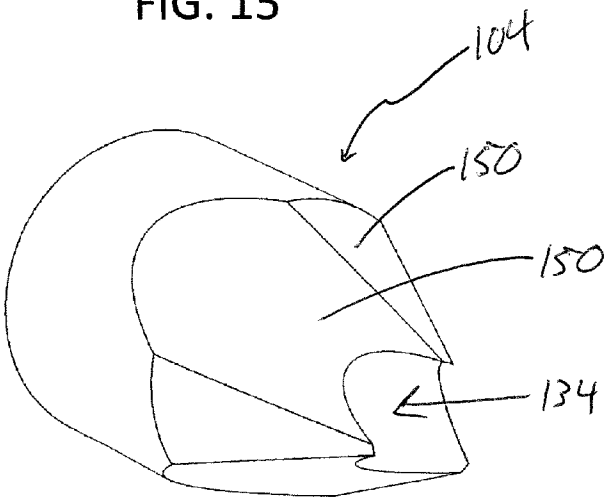
FIG. 17 is a perspective view of an arrowhead tip according to an example embodiment of the present invention.
Figure 19:
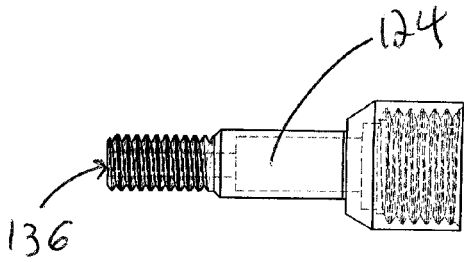
FIG. 19 is a side view of an arrowhead battery housing according to an example embodiment of the present invention.

As can be seen in FIGS. 9 and 19, the battery housing 106 further includes a rear laser cavity 124. The rear laser cavity 124 is configured to receive a rear laser diode module or led assembly 122. One suitable rear laser component is a 650 nm, 3.3 mm, CAN-style laser diode. However, other light sources, such as light emitting diodes and other types of laser diodes may be used without departing from the scope of the invention. The rear laser diode 122 or light source is activated by the microprocessor when the accelerometer indicates that it has reached a set velocity.

As described previously, the rear laser or led 122 will shine through the hollow shaft of the arrow and illuminate the transparent nock. Illuminating the nock using this method and configuration does not add additional weight to the rear of the arrow, which is an advantage over conventional lighted nocks. Illuminating the nock using a collimated laser diode allows the nock to become much brighter than conventional lighted nocks, which is an advantage over conventional devices.

In one particular variation, the circuit board 114, front laser diode 112 and spring contact 118 may be encased in a molding to protect the components from high g-forces. The molding can be a plastic material molded over the above-mentioned components.

Figure 7:
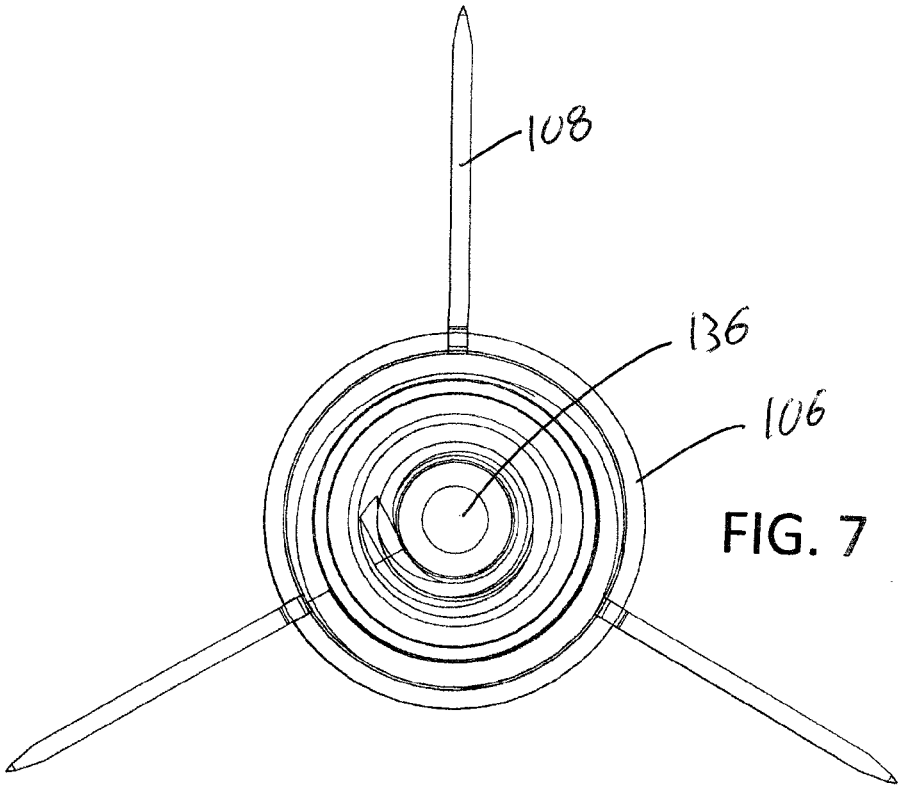
FIG. 7 is a rear view of an arrowhead showing hidden detail according to an example embodiment of the present invention.
Figure 8:
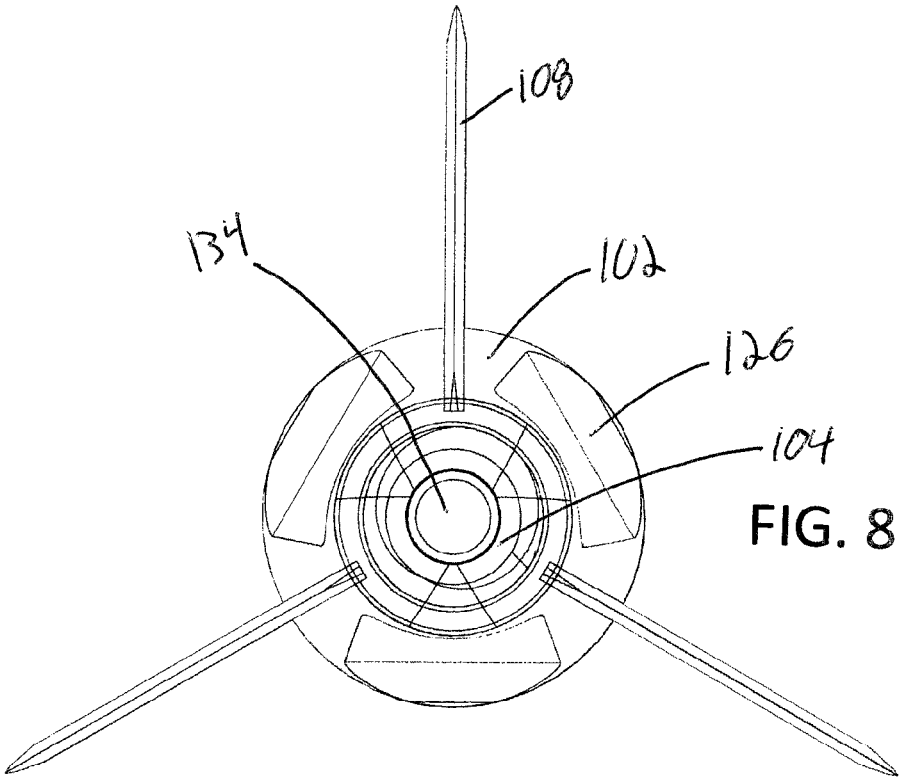
FIG. 8 is a front view of an arrowhead showing hidden detail according to an example embodiment of the present invention.

Referring to FIGS. 7-9, the arrowhead 100 is shown with various hidden detail in order to better understand this disclosure. The body 102 includes a plurality of facets 126 arrayed around its longitudinal outer surface. These facets 126 comprise a generally planar portion 128 spanning between two beveled portions 130 and 132. Front beveled portion 130 is located adjacent the front of the arrowhead. Rear beveled portion 132 is located rearward of the front beveled portion 130. The preceding configuration reduces the amount of friction that is caused on the body 102 while penetrating a target and reduces the total weight of the arrowhead.

A front aperture 134 in the tip 104 of the arrowhead extends from the front of the laser diode 112 through the tip 104. This front aperture 134 permits the collimated laser light to emit from the arrowhead in a forward direction.

A rear aperture 136 in the battery housing extends from the rear laser through the end of the battery housing. This rear aperture 136 in the battery housing 106 permits the light from rear laser or led 122 to travel through the hollow shaft of the arrow to illuminate the nock.

FIG. 9 also shows the assembly of the body 102, tip 104 and battery housing 106. The body 102 has a front male threaded portion 138 for securing with a corresponding female threaded portion of the tip 104. The body 102 also has a rear male threaded portion 140 for securing with a corresponding female threaded portion of the battery housing 106. The battery housing 106 has a male threaded portion 142 for securing with a corresponding female threaded portion of the arrow shaft.

Referring to FIGS. 10-14, the arrowhead body 102 is shown. The body 102 comprises an aluminum material, although other materials, for example plastics and metals, can be used without departing from the scope of the invention. The internal diameter of the front male threaded portion 138 defines the front aperture 134 or opening through which the forward laser light emanates. The internal diameter of the rear male threaded portion 142 of the battery housing 106 defines the rear aperture 136 or opening through which the rearward light emanates.

A slot, channel or groove 144 is defined in the outer longitudinal surface of the body 102 and spans between the front threaded portion 138 and rear threaded portion 140. Groove 144 is configured and sized to receive a blunt side edge of the blades. The grooves are disposed radially in between the facets 126.

Three set screws 146 are provided in their respective apertures in the front beveled portions 130 to permit adjustment of the aim of the front laser diode 112. Thus, the laser beam direction can be adjusted to ensure that it is co-axial with the center axis of the arrow shaft.

Referring to FIGS. 15-18, the tip 104 of the arrowhead is shown. The internal diameter of the tip defines the front aperture 134 or opening through which the forward laser light emanates. The rear of the tip includes a recessed or female threaded portion 148 for rotational securement of the front portion of the blades 108 and with the respective front male threaded portion 138 of the body.

The tip 104 further includes a plurality of facets or beveled portions 150 that start at the outer diameter of the converge as they approach the forward-most portion of the tip 104. The facets 150 terminate at the intersection with the front aperture 134 in three peaks or points and define a sharpened hollow tip. The hollow tip configuration is advantageous because the entire cutting diameter is sharpened, unlike tips that form a single point.

The hollow tip configuration punches a hole in the target surface, instead of the conventional 3 cut lines created by a single tip configuration. In addition, blood in target prey is less able to coagulate due to the wound shape compared to a conventional configuration. As a result, a faster bleedout is achieved from both entry and exit wounds of the prey. A faster bleedout creates an improved blood trail and a faster kill. A faster kill is more humane and makes the wounded prey easier to track. The tip 104 comprises a stainless steel material, although other materials, for example plastics and metals, can be used without departing from the scope of the invention.

Figure 20:
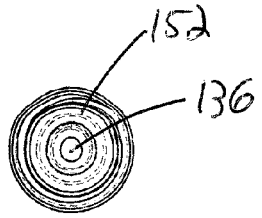
FIG. 20 is a front view of an arrowhead battery housing according to an example embodiment of the present invention.
Figure 21:
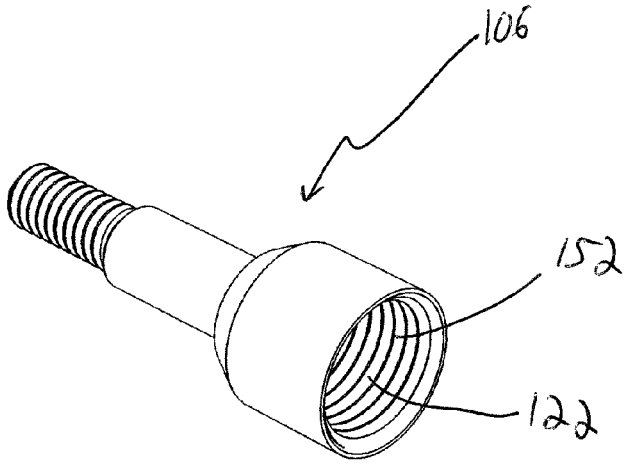
FIG. 21 is a perspective view of an arrowhead battery housing according to an example embodiment of the present invention.

Referring to FIGS. 19-21, the battery housing 106 of the arrowhead is shown. The rear-facing minor internal diameter of the housing 106 defines the rear aperture 136 or opening through which the rear laser or light emanates. The forward facing portion of the housing 106 includes a recessed or female threaded portion 152 for rotational securement with the respective rear male threaded portion 140 of the body 102. The housing 106 comprises an aluminum material, although other materials, for example plastics and metals, can be used without departing from the scope of the invention.

Figure 23:
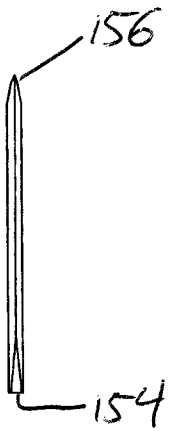
FIG. 23 is a front view of an arrowhead blade according to an example embodiment of the present invention.
Figure 22:
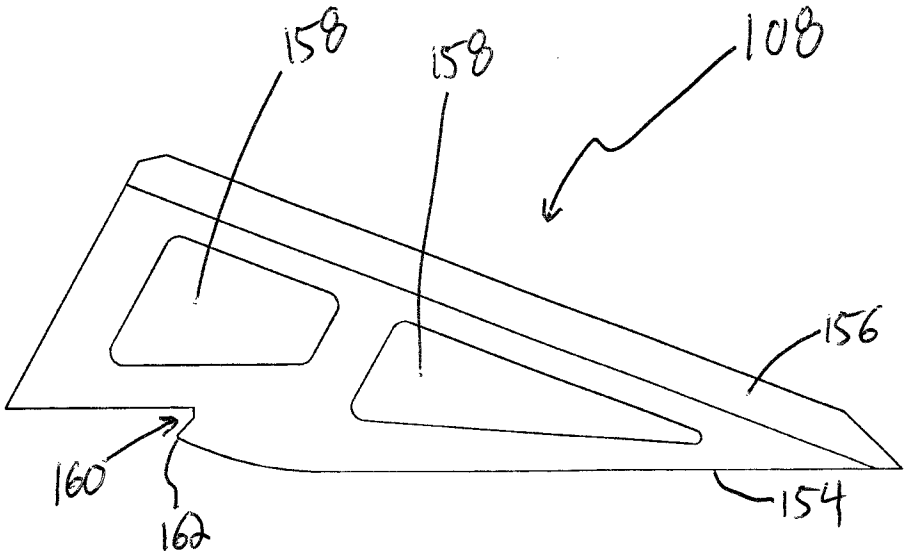
FIG. 22 is a side view of an arrowhead blade according to an example embodiment of the present invention.
Figure 24:
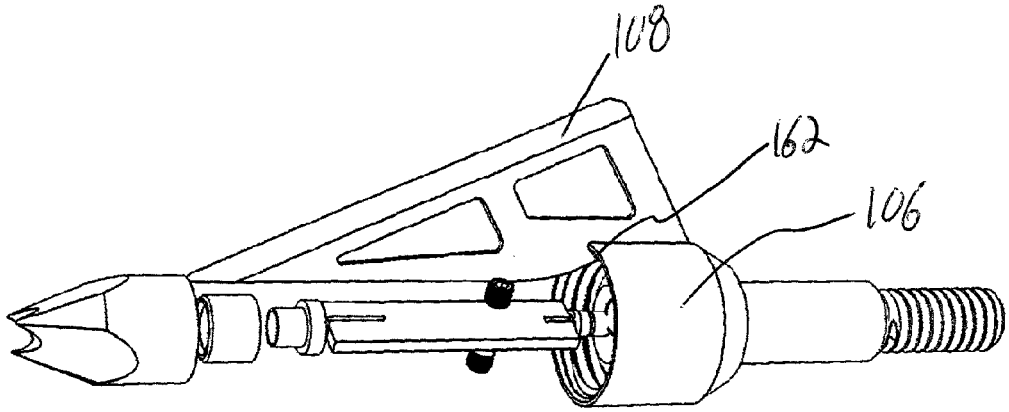
FIG. 24 is a cutaway perspective view of an arrowhead according to an example embodiment of the present invention.
Figure 25:
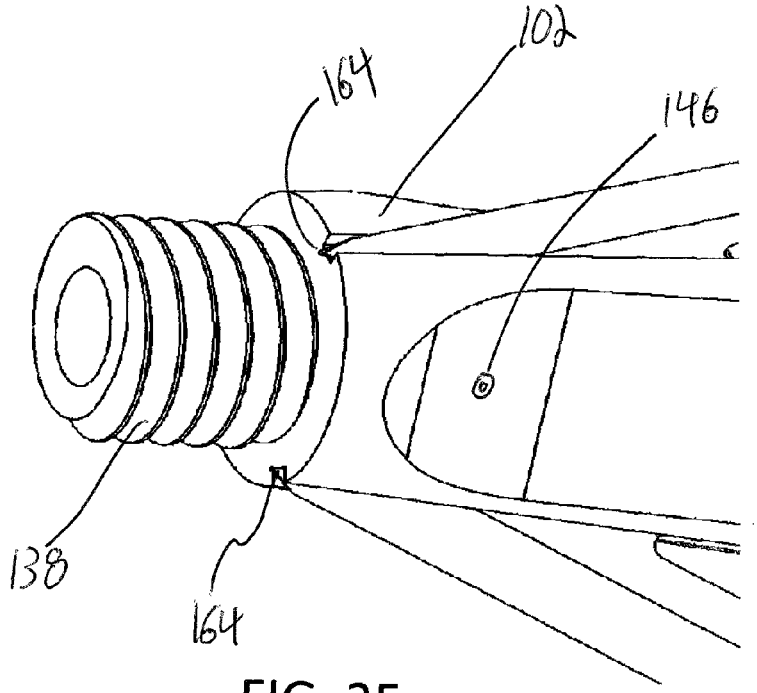
FIG. 25 is a perspective view of a portion of an arrowhead according to an example embodiment of the present invention.
Figure 26:
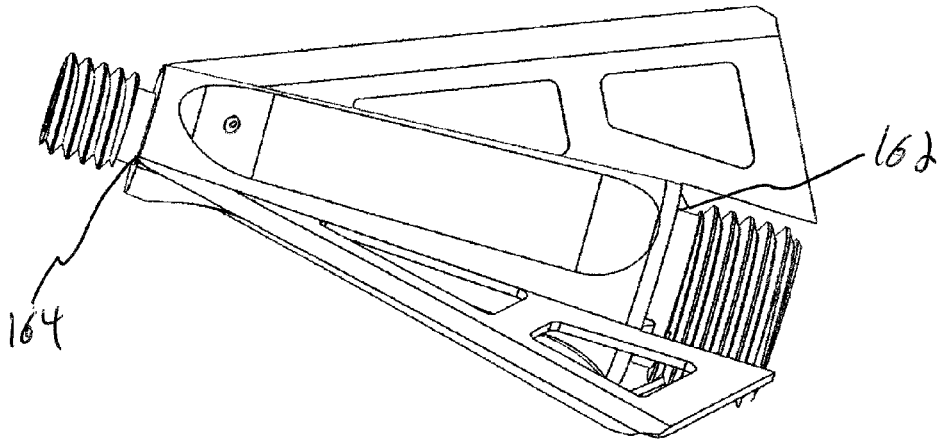
FIG. 26 is a perspective view of a portion of an arrowhead according to an example embodiment of the present invention.
Figure 27:
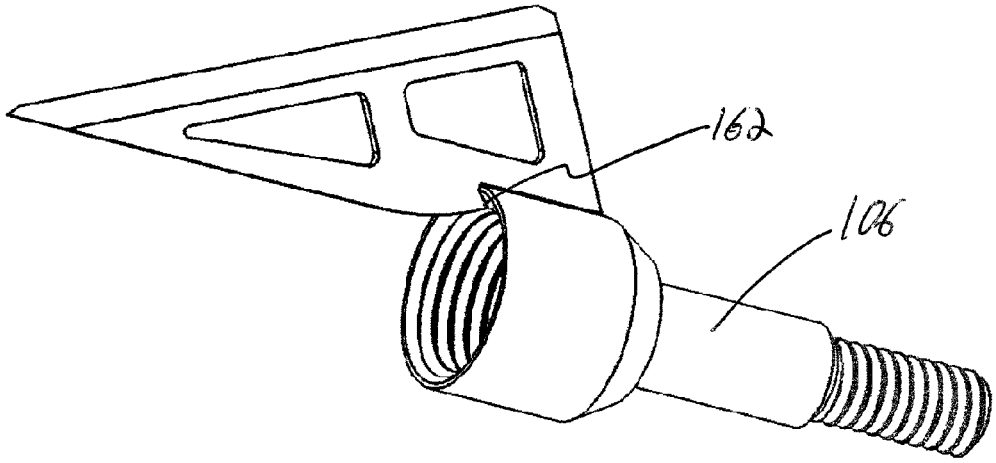
FIG. 27 is a perspective view of a portion of an arrowhead according to an example embodiment of the present invention.
Figure 28:
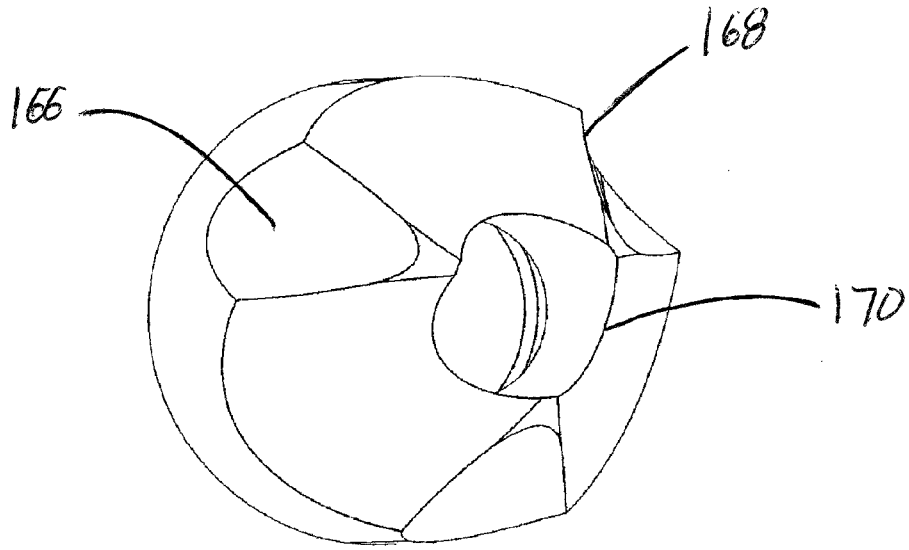
FIG. 28 is a perspective view of an arrowhead tip according to an example embodiment of the present invention.
Figure 29:
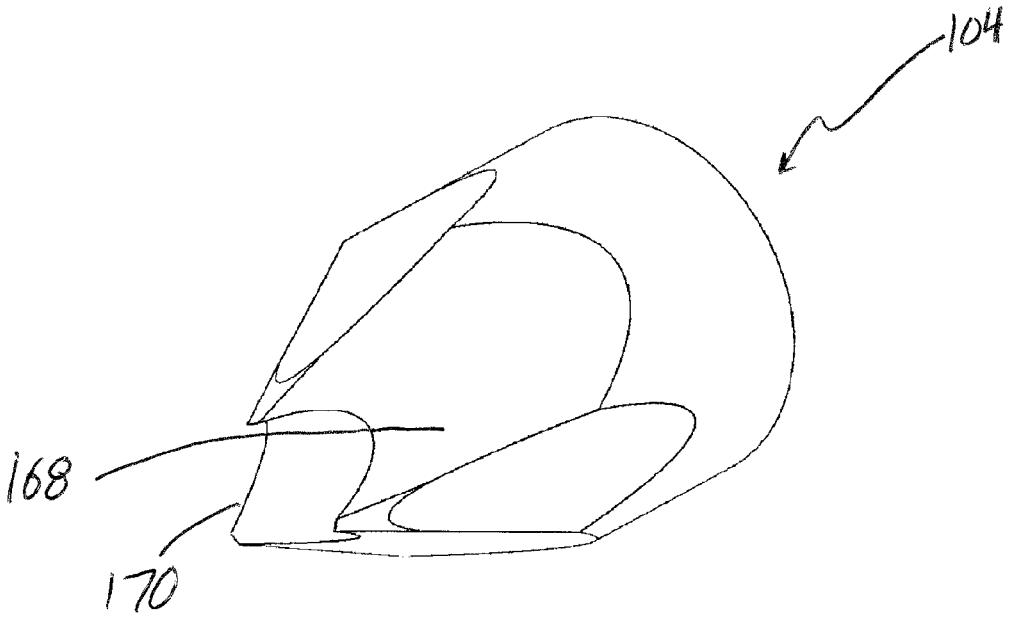
FIG. 29 is a perspective view of an arrowhead tip according to an example embodiment of the present invention.
Figure 30:
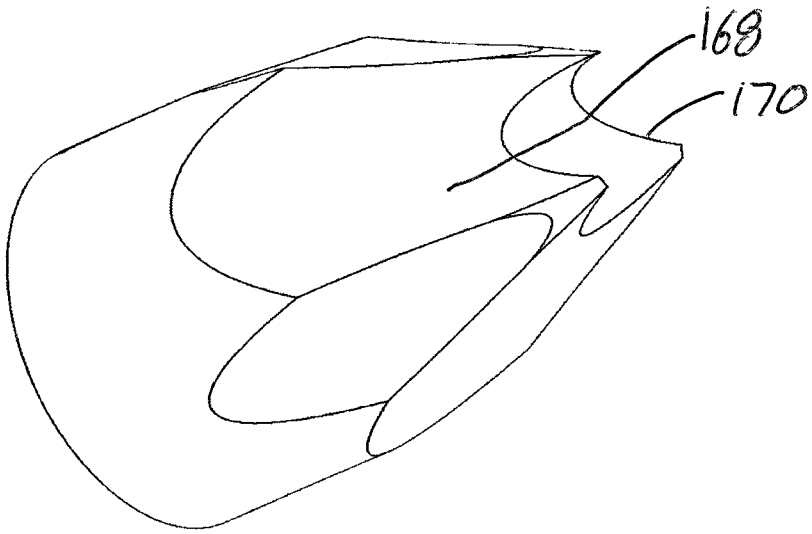
FIG. 30 is a perspective view of an arrowhead tip according to an example embodiment of the present invention.
Figure 31:
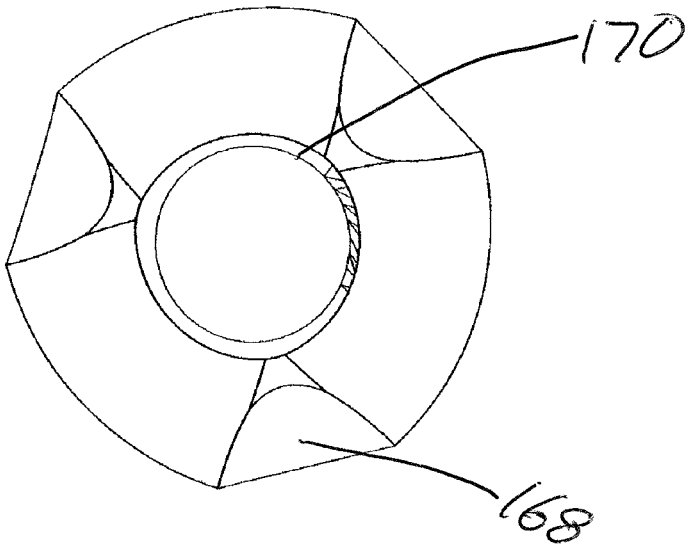
FIG. 31 is a front view of an arrowhead tip according to an example embodiment of the present invention.
Figure 32:
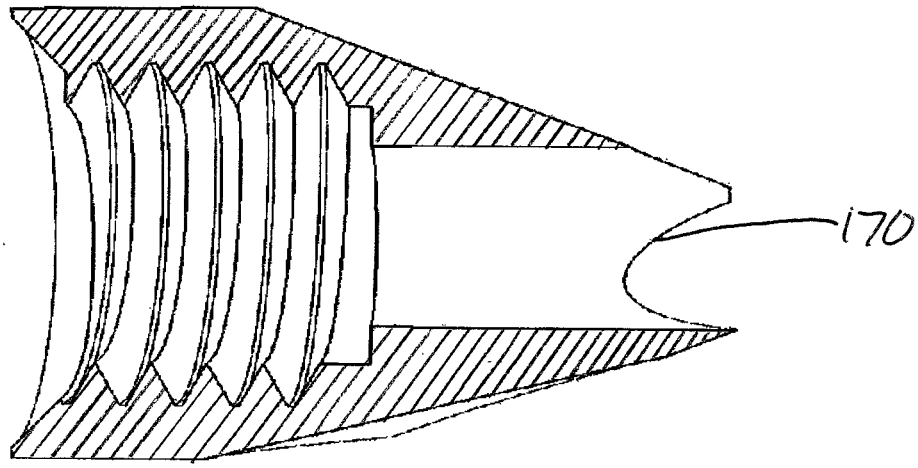
FIG. 32 is a side sectional view of an arrowhead tip according to an example embodiment of the present invention.
Figure 33:
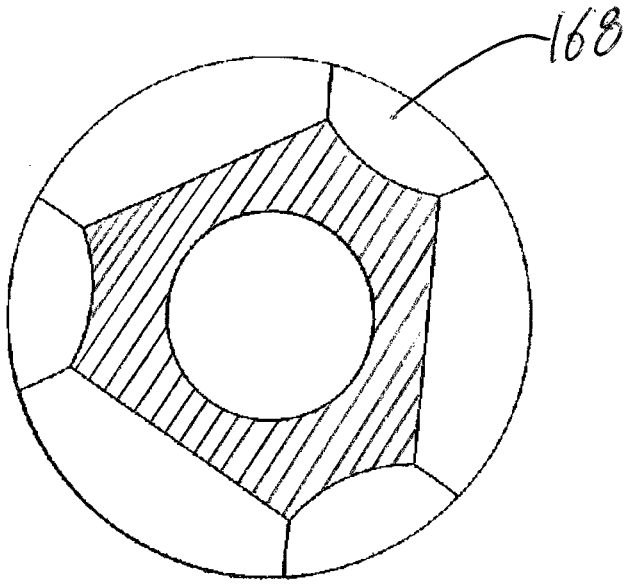
FIG. 33 is a front sectional view of an arrowhead tip according to an example embodiment of the present invention.

Referring to FIGS. 22-23, a blade 108 of the arrowhead is shown. The blade 108 comprises a stainless steel material, although other materials, for example plastics and metals, can be used without departing from the scope of the invention. The blade 108 is generally triangular shaped in side profile. The blade 108 includes a blunt side or edge 154 configured to be received in the groove 144 of the body 102. Opposing the blunt side at an oblique angle is a sharpened side or edge 156. The sharpened side 156 presents a sharp edge for cutting the flesh of the target. The flat side surfaces spanning between the blunt 154 and sharp edges 156 may be provided with one or more apertures 158 therethrough. The apertures 158 provide for a lighter blade. A securement notch 160 is defined in the blunt edge 154 and is configured to contact an inside diameter of the female portion 152 of the battery housing 106. Such configuration permits the blade 108 to be secured in the groove 144 of the body 102 as will be explained in the following paragraphs. The blades extend rearward past the arrowhead body 102 to provide for more cutting surface without adding significant weight. The arrowhead may be configured to have two, three, four or more than four blades.

Referring to FIGS. 24-27, it can be seen that the notch 160 of the blade 108 abuts against the outer diameter of the female portion of the battery housing 106. The flanged portion 162 of the notch protrudes inside of the periphery of the battery housing 106 so that it cannot be pulled away from the arrowhead body when secured in place. The forward corner of the blade formed by the intersection of the blunt '54 and sharp 156 edges is secured in place by fastening of the tip 104 on the body 102. The forward tip 164 of the blade 108 protrudes forward beyond the groove. The protruding portion 164 is secured in place by the inner diameter of the threaded portion of the tip 104 when tightened in the front male threads 138 of the body 102.

Referring to FIGS. 28-33, another embodiment of the arrowhead tip 104 can be seen. This configuration includes a three-point tip with six-cutting edges. There are six scalloped regions 166 radially spaced, thereby defining six cutting edges 166. The scalloped areas 166 may be of varied size or shape, or all similar. In the configuration shown, the sizes and shapes are varied so as to define three projecting pointed tips arrayed about the circular sharpened cutting surface 170. Increasing the number of cutting surfaces reduces the friction that each surface experiences when impacting the target surface. Thus the target surface penetration is more efficient. This makes it easier for the tip 104 to penetrate the target surface.

Figure 34:
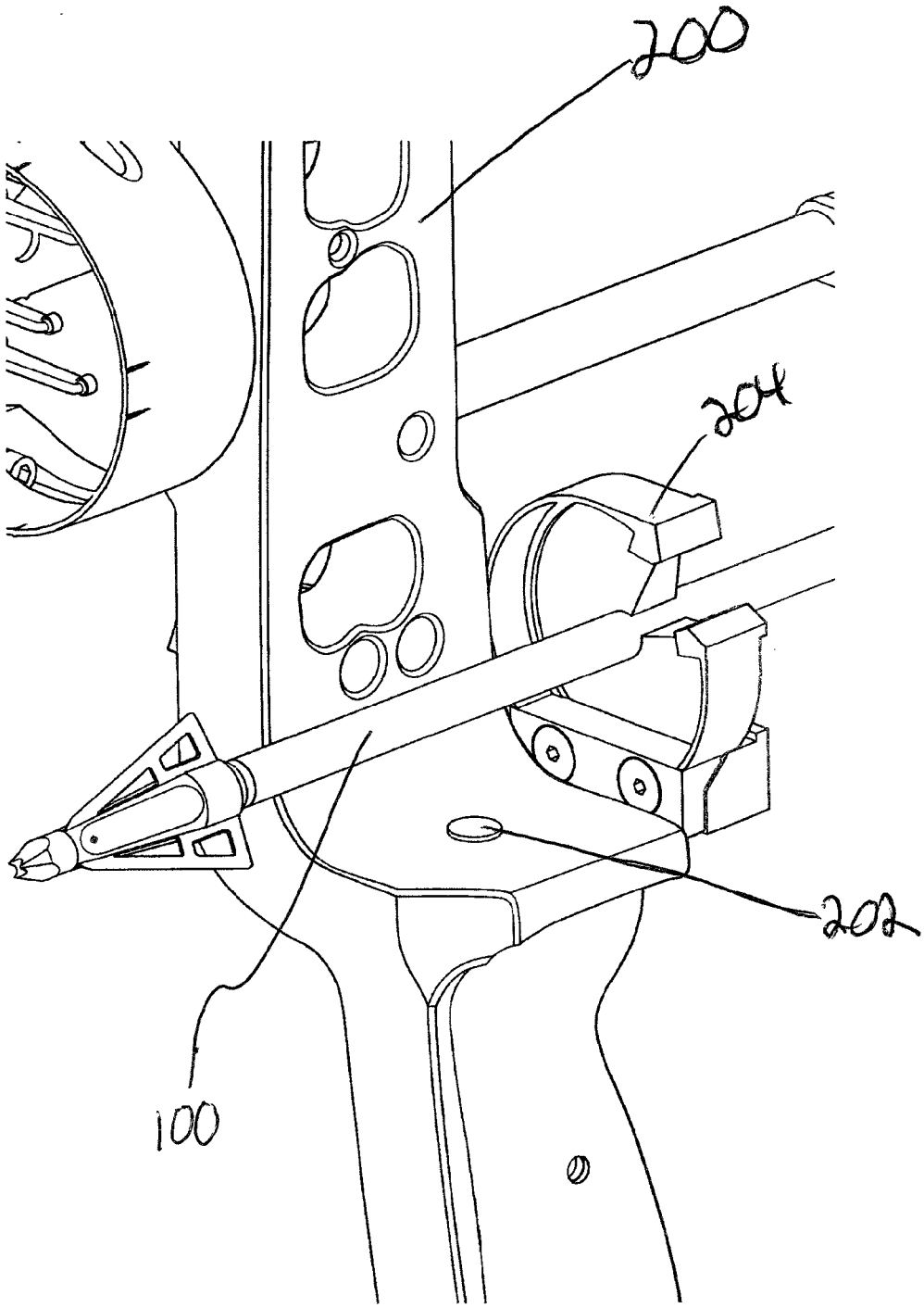
FIG. 34 is a perspective view of a portion of a bow with a portion of an arrow according to an example embodiment of the present invention.
Figure 35:
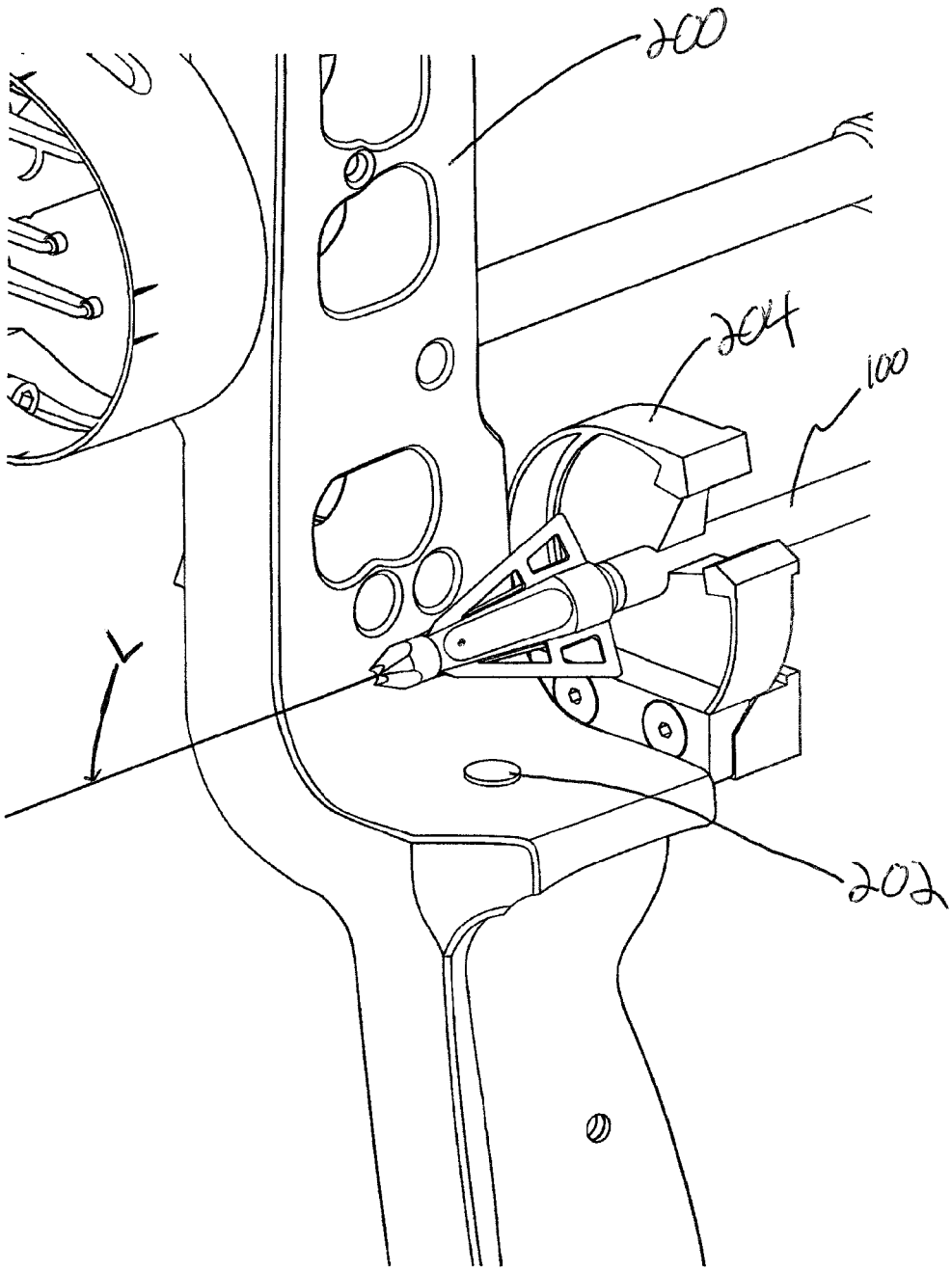
FIG. 35 is a perspective view of a portion of a bow at full draw with a portion of an arrow according to an example embodiment of the present invention.

Referring to FIGS. 34-35, the use of the hall effect sensor to turn the forward laser on is illustrated. It should be understood that the bow and bow rest structure illustrated in the figures is exemplary and that other types and configurations can be used without departing from the scope of the invention. The bow 200 is provided with a magnet 202 near the arrow rest 204 on a horizontal surface. Alternatively, the magnet could be provided to a vertical surface. In a further alternative, multiple magnets can be provided on more than one surface.

In FIG. 34, the arrow is not yet at full draw. The forward laser is not yet turned on. Now referring to FIG. 35, the arrow is shown at full draw on the bow. The proximity to the magnet 202 has triggered the hall effect sensor and the laser is turned on as illustrated by the laser beam L. The beam L will cause a spot to illuminate on the target corresponding to the center axis of the arrow. Thus, the archer or user is able to best aim the bow. Once the hall effect sensor is no longer in proximity to the magnet, it will turn the forward laser off. The above described operation conserves battery power.

The magnet and hall effect sensor combination provides certain additional benefits. For example, the laser turning on indicates to the archer that a correct full draw for their arrow length has been achieved and can be used to establish good shooting habits. When hunting, the archer can purposefully over draw or under draw the bow to prevent the laser from turning on until they are ready to take a shot. This conserves battery power and prevents the laser from being on when stalking game so not to alarm the game until a shot is desired. Also, the magnet or magnets help keep the arrowhead in the correct position when at full draw. This is due to the magnetic force exerted on the ferrite material in the arrowhead blades. This stabilizing feature is particularly desired when the user is located, for example, in a tree stand and must hold the bow at a downward or rotated angle where the bow may not be level with the ground.

Figure 36:
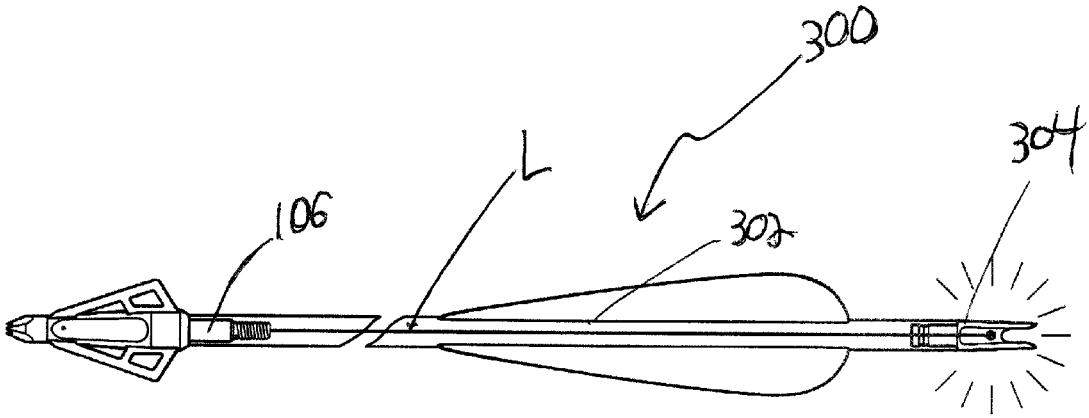
FIG. 36 is a side view of an arrow according to an example embodiment of the present invention showing certain internal detail.

Referring to FIG. 36, an arrow 300, showing internal detail, is depicted in order to illustrate the illuminated nock feature.

The laser or led light L emanating from the rear laser or led in the battery housing 106 travels through the hollow arrow shaft 302 until it encounters the nock 304 disposed at the rear of the arrow shaft 302. The clear prismatic nock 304 illuminates due to the internal reflection of the laser or led light. The nock 304 comprises a clear plastic material, but other materials may be used without departing from the scope of the invention. The illuminated nock 304 makes it easier to locate the arrow, and thus any prey in which it is embedded. The nock 304 can be lit constantly, or pulsed to transmit encoded data to a receiver device. This configuration does not require additional electronic components disposed in the rear of the arrow 300, so the balance and overall weight of the arrow does not become undesirable.

Figure 37:
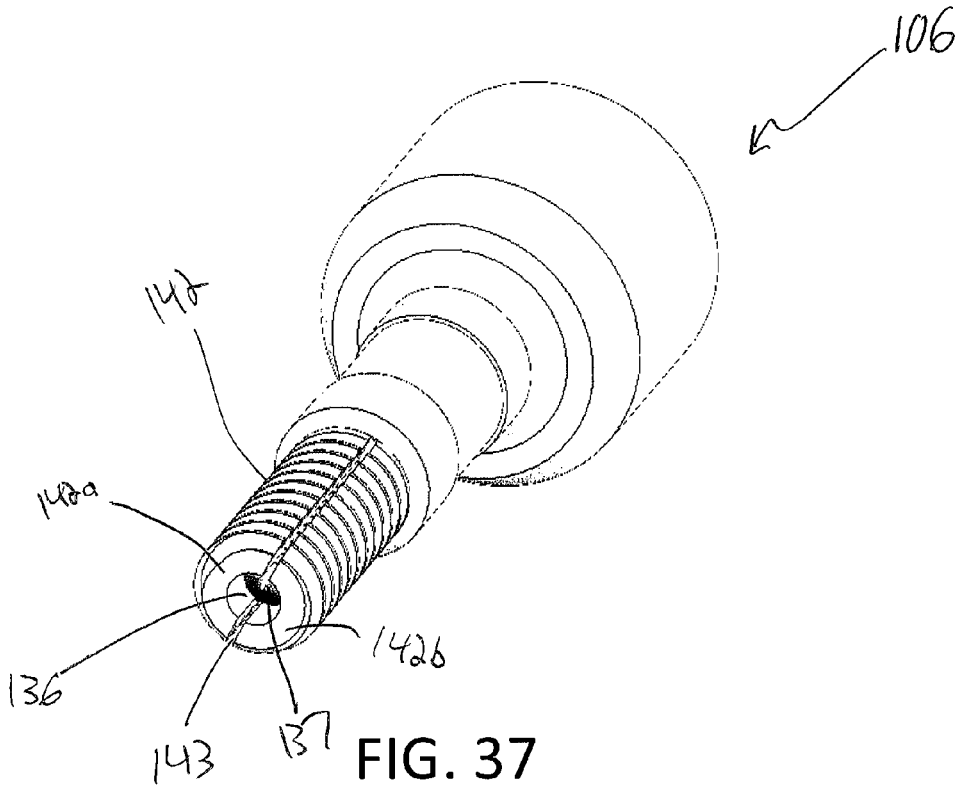
FIG. 37 is a perspective view of an arrowhead battery housing according to an example embodiment of the present invention
Figure 38:
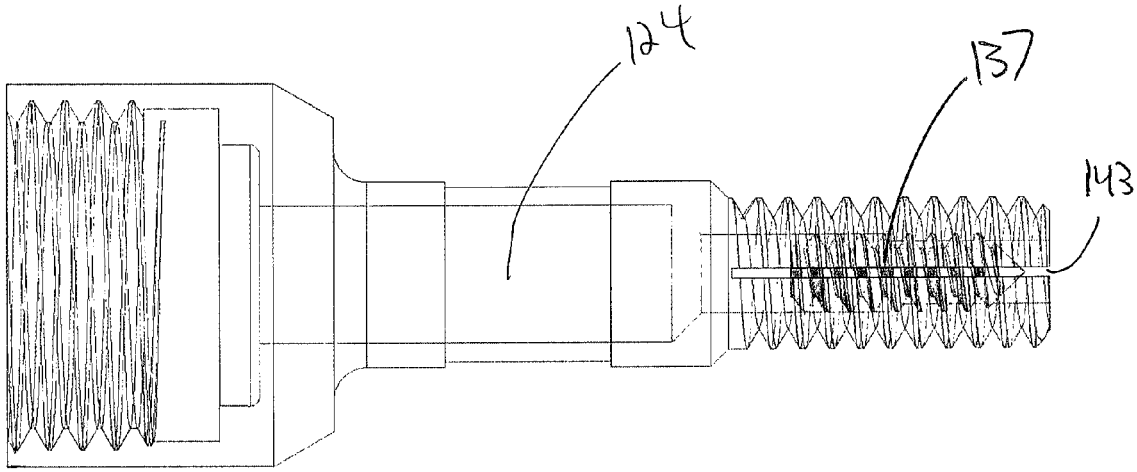
FIG. 38 is a side view of an arrowhead battery housing according to an example embodiment of the present invention
Figure 39:
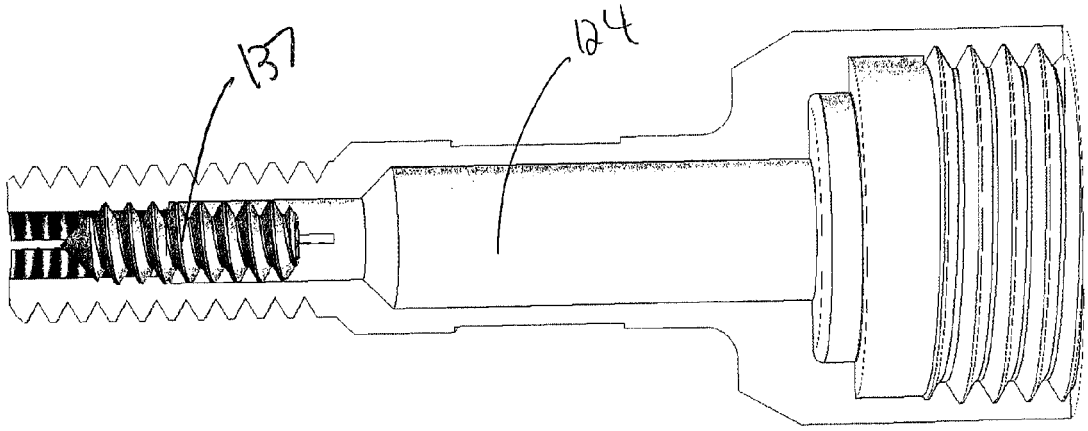
FIG. 39 is a side view of an arrowhead battery housing according to an example embodiment of the present invention.

Referring to FIGS. 37-39, the battery housing 106 is shown according to an additional aspect of certain embodiments of the invention. At least a portion of the male threaded portion 142 of the housing 106 is slotted to form first 142*a* and second 142*b* halves. The slot is designated as inset 143 on the drawings. The inset extends from the outlet of the rear aperture 136 upwards towards the laser cavity 124. A portion or the entirety of the threaded portion 142 may be slotted.

The slot permits each half 142*a* and 142*b* to flex slightly outward from the center bore 136. Thus, the thread halves are configured to expand when a set-screw 137 is inserted into the bore and tightened. The bore can be threaded to facilitate use of the set-screw. As the set screw is tightened down, the side walls of the threaded portion expand laterally outward to lock the broadhead assembly 100 into the arrow shaft.

The set screw locking feature makes the broadhead rotation adjustable or indexable with respect to the rotational orientation of the vanes of the arrow. In contrast, conventional inserts are typically glued into the arrow shaft, so existing broadheads are tightened down until they stop against the front of the insert. This does not allow the end user to align the broadhead to the arrow shaft. The present invention thus allows the end user to make fine adjustments to their broadhead to help tune the arrow and provide for better flight characteristics. For example, aligning the broadhead blades rotationally with the arrow vanes helps with arrow flight and permits the broadhead to remain in the same position (and be repeatedly used in that same orientation) after the laser beam has been aligned so that the arrow can best hit the target at a given distance.

Various embodiments of the present invention can be used in conjunction with the electronic archery sighting system disclosed in co-pending U.S. patent application Ser. No. 12/757,893, entitled, "ELECTRONIC ARCHERY SIGHTING SYSTEM AND BORE SIGHTING ARROW", filed on Apr. 9, 2010, inventor Larry Bay, the disclosure of which is hereby incorporated by reference.

The above disclosure is related to the detailed technical contents and inventive features thereof. People skilled in this field may proceed with a variety of modifications and replacements based on the disclosures and suggestions of the invention as described without departing from the characteristics thereof. For example, the invention is also applicable to cross bows, spear fishing guns and other projectiles that would benefit from a laser aiming pointed tip. Nevertheless, although such modifications and replacements are not fully disclosed in the above descriptions, they have substantially been covered in the following claims as appended.

What is claimed is:

1. An arrowhead comprising:

a body, the body including an internal cavity;

a plurality of blades extending outwardly from the body;

a sharpened tip extending forwardly from the body, the tip having a center axis, and an aperture formed in the tip that extends outward along the center axis of the tip;

a battery housing extending rearwardly from the body, the battery housing including a rearwardly extending threaded portion, the threaded portion including a hole defined longitudinally therethrough, and the threaded portion being sectioned longitudinally into first and second halves with a slot defined between the first and second halves;

a battery disposed in the battery housing; and a front laser diode disposed in the internal cavity of the body, the front laser diode arranged so that the laser beam emitted by the diode projects forward from the arrowhead through the aperture in the tip, the laser beam being coaxial with the center axis of the tip.

2. The arrowhead of claim 1, further comprising a hall effect sensor disposed in the body, the hall effect sensor configured to detect the proximity of the arrowhead to a magnet disposed on a bow.

3. The arrowhead of claim 1, further comprising an accelerometer disposed in the body.

4. The arrowhead of claim 1, further comprising a rear facing light source disposed in the battery housing.

5. The arrowhead of claim 1, further comprising a set screw disposed in the hole defined longitudinally through the threaded portion.

6. The arrowhead of claim 1, further comprising a collimating lens disposed in the body and arranged so that the laser beam projected by the front laser diode travels through the lens before exiting the tip.

7. The arrowhead of claim 1, further comprising a set screw disposed in the body and configured to adjust the aim of the laser beam emitted by the front laser diode.

8. The arrow of claim 1, wherein the tip comprises a first tip point, a second tip point and a cutting edge disposed between the first and second tip point.

9. An arrow comprising:

a hollow shaft having a front end and a rear end;

a nock disposed on the rear end of the shaft; and an arrowhead disposed at the front end of the shaft, the arrowhead comprising:

a body having a forward end and a rearward end, the body including a microprocessor disposed therein;

a tip disposed on the forward end of the body, the tip including a plurality of sharpened points and cutting edges;

a housing disposed on the rearward end of the body, the housing including a rearwardly extending threaded portion, the threaded portion being sectioned longitudinally into first and second halves with a slot defined between the first and second halves.

10. The arrow of claim 9, further comprising:

an accelerometer disposed in the body and in communication with the microprocessor.

11. The arrow of claim 9, further comprising:

a forward facing laser diode disposed in the body; and an aperture defined in the tip and configured to permit a light beam from the forward facing laser to exit the tip along a central axis of the arrow.

12. The arrow of claim 11, further comprising a hall effect sensor disposed in the body, the hall effect sensor responsive to a magnet disposed on a bow.

13. The arrow of claim 11, wherein the arrowhead further comprises a collimating lens disposed in the body and arranged so that the laser beam projected by the forward facing laser diode travels through the lens before exiting the tip.

14. The arrow of claim 9, wherein the arrowhead comprises a plurality of blades, each blade disposed in a groove defined in the body, each blade having a flanged portion and a forward corner, wherein the blade is secured to the body by flanged portion interfacing with the housing and the forward corner interfacing with the tip.

15. The arrow of claim 9, further comprising a rear facing light source disposed in the cavity of the housing, the rear facing light source having an unobstructed path through the shaft to the nock, the light source selectively lighting the nock.

16. A method of shooting an arrow, the arrow comprising an arrow head, a shaft and a plurality of vanes, the method comprising:

indexing the arrowhead to the plurality of vanes by tightening a set screw disposed in a portion of the arrowhead;

disposing a magnet on a bow;

engaging an arrow with the bow;

drawing the arrow back until a forward facing laser beam in the arrowhead turns on in response to a hall effect sensor sensing the presence of the magnet; and turning off the forward facing laser beam when the hall effect sensor does not sense the presence of the magnet.

17. The method of claim 16, further comprising: wherein the tightening of the set screw laterally expands a portion of the arrow head disposed within the arrow shaft.

18. The method of claim 16, further comprising: determining whether the arrow has reached a preset flight speed and turning on a rear-facing light source disposed in the arrowhead to illuminate the nock.

19. The method of claim 18, further comprising: storing flight data for the arrow in a memory disposed in the arrowhead.

20. The method of claim 19, further comprising: pulsing the illuminations of the nock to transmit the flight data to a device configured to decode the transmitted flight data.

21. An arrowhead comprising:

a body portion having a forward end and a rearward end, the body defining a non-threaded hollow interior portion, the forward end defining an opening into the non-threaded hollow interior portion;

a removable tip portion securable to the forward end of the body;

a circuit board disposed within the non-threaded hollow interior portion; and a flight data sensor disposed within the non-threaded hollow interior portion.

22. The arrowhead of claim 21, wherein the flight data sensor is an accelerometer.

* * * * *